US007154231B2

(12) United States Patent
Chou et al.

(10) Patent No.: US 7,154,231 B2
(45) Date of Patent: Dec. 26, 2006

(54) GAS DISCHARGE LAMP DIMMING CONTROL METHOD

(75) Inventors: Chin-Wen Chou, Taipei Hsien (TW); Ying-Nan Cheng, Taipei Hsien (TW); Chin-Biau Chung, Taipei Hsien (TW)

(73) Assignee: Zippy Technology Corp., Taipei Hsien (TW)

( * ) Notice: Subject to any disclaimer, the term of this patent is extended or adjusted under 35 U.S.C. 154(b) by 62 days.

(21) Appl. No.: 11/126,345

(22) Filed: May 11, 2005

(65) Prior Publication Data

US 2006/0255748 A1 Nov. 16, 2006

(51) Int. Cl.
*H05B 37/02* (2006.01)

(52) U.S. Cl. ..... 315/224; 315/209 R; 315/DIG. 5; 315/DIG. 7; 315/291

(58) Field of Classification Search ..... None
See application file for complete search history.

(56) References Cited

U.S. PATENT DOCUMENTS 6,949,888 B1 * 9/2005 Ribarich ..... 315/291
2005/0062444 A1 * 3/2005 Chou et al. ..... 315/308
2006/0125413 A1 * 6/2006 Chou et al. ..... 315/224

FOREIGN PATENT DOCUMENTS

TW 504101 9/2002

* cited by examiner

*Primary Examiner*—Tuyet Thi Vo
(74) *Attorney, Agent, or Firm*—Birch, Stewart, Kolasch & Birch, LLP

(57) ABSTRACT

A gas discharge lamp dimming control method aims to provide a dimming period after a start period when a gas discharge lamp is ignited. The dimming period has a duty voltage set initially or corresponding to a remained dimming value in a pervious OFF condition of the gas discharge lamp. Hence the gas discharge lamp is provided with electric energy and maintained in a start condition in the dimming period at any dimming value setting. The duty voltage during the dimming period lasts a length equal to that of the dimming period to allow the gas discharge lamp to gradually restore the required dimming illumination in the start condition and achieve a maximum dimming range.

7 Claims, 4 Drawing Sheets

GAS DISCHARGE LAMP DIMMING CONTROL METHOD

FIELD OF THE INVENTION

The present invention relates to a gas discharge lamp dimming control method and particularly to a dimming control method for gas discharge lamps during transformation of different dimming value settings.

BACKGROUND OF THE INVENTION

The dimming methods for the conventional cold cathode fluorescent lamp (CCFL) generally include duty cycle control, frequency control and voltage control.

R.O.C. Patent Publication No. 504101 discloses an "Actuation device for high luminous fluorescent lamps". In mainly includes a high frequency oscillator, a pulse width modulator, a first and a second power switches, and a piezoelectric transformer. The high frequency oscillator generates a high frequency AC signal which is transformed to a PWM resonant frequency signal through the pulse width modulator. The positive half cycle and the negative half cycle of the PWM resonant frequency signal drive respectively the two power switches, and then they actuate respectively two input ends of the primary coil of the piezoelectric transformer. Thereby the piezoelectric transformer generates a pulse wave to actuate the CCFL. The CCFL actuation device thus formed has higher transformation efficiency and a step-up ratio of high pulse wave. In short, that patent adopts the pulse width modulation to actuate the piezoelectric transformer through a constant high frequency signal, and control the power switches through a non-continuous conductive mode of constant conduction. This method generally controls the average current of the fluorescent lamp through a high frequency (>100 Hz) not visible to human eyes and by modulating the OFF period of the duty ratio. The frequency is constant.

Another control method being taken seriously is digital dimming or called burst dimming. This method aims to control the lamp current to function at a steady nominal value. Then a low frequency dimming (LFD) control voltage is used to regulate the duty/close cycles (i.e. ON/OFF cycles) of the lamp. The average illumination of the lamp is direct proportional to the duty cycle. Hence the average illumination can be controlled. However, the conventional techniques mostly adopt hard-start at a constant frequency. Referring to FIGS. 1 and 2, the general start voltage is about 2–4 times of the duty voltage. In the OFF cycle, the OFF potential is zero (namely no current). For a gas discharge lamp, a certain amount of electric energy is required to actuate the ignition. But such a control method is set in a condition of a lower dimming value (usually below 30%). As a result, the electric energy required by the gas discharge lamp in the duty cycle often is not adequate and results in partial ignition of the gas discharge lamp. When the gas discharge lamp is used as the light source of a display screen, the illumination is not even or flicker occurs. Hence the present fabrication technique can only set the dimming value of the gas discharge lamp in the range between 30% and 100%. If the dimming value is lower than the range mentioned above, the gas discharge lamp is OFF and not operable. In some special environments where the display illumination is low (such as the vehicles moving in a bright sunshine environment), the control method previously discussed is useless. To overcome this problem, some adopt the approach of neglecting the shortcomings of uneven illumination or flicker phenomenon. But due to the actuation electric energy is not adequate, to restore the dimming cycle in the standard dimming range the lamp has to be turned ON and OFF repeatedly. Namely, a start cycle must be generated first when to restore the dimming value to a higher setting condition. Each start cycle will generate a higher start voltage and a surge current. This is harmful to the electrodes of the gas discharge lamp. Hence the conventional digital dimming method has a negative impact to the service life of the lamp.

SUMMARY OF THE INVENTION

Therefore the primary object of the present invention is to solve the aforesaid disadvantages. The invention provides a dimming cycle for a gas discharge lamp after the start cycle of the ignition of the gas discharge lamp. The dimming cycle has a duty voltage set initially or corresponding to a remained dimming value in the previous OFF period of the gas discharge lamp. Thereby the gas discharge lamp can maintain a start condition with desired electric energy in any dimming value setting during the dimming cycle. As the duty voltage during the dimming cycle is corresponding to different dimming values and lasts a length same as the dimming cycle, the gas discharge lamp can gradually restore the required dimming illumination in the start condition, and a maximum dimming range can be achieved.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
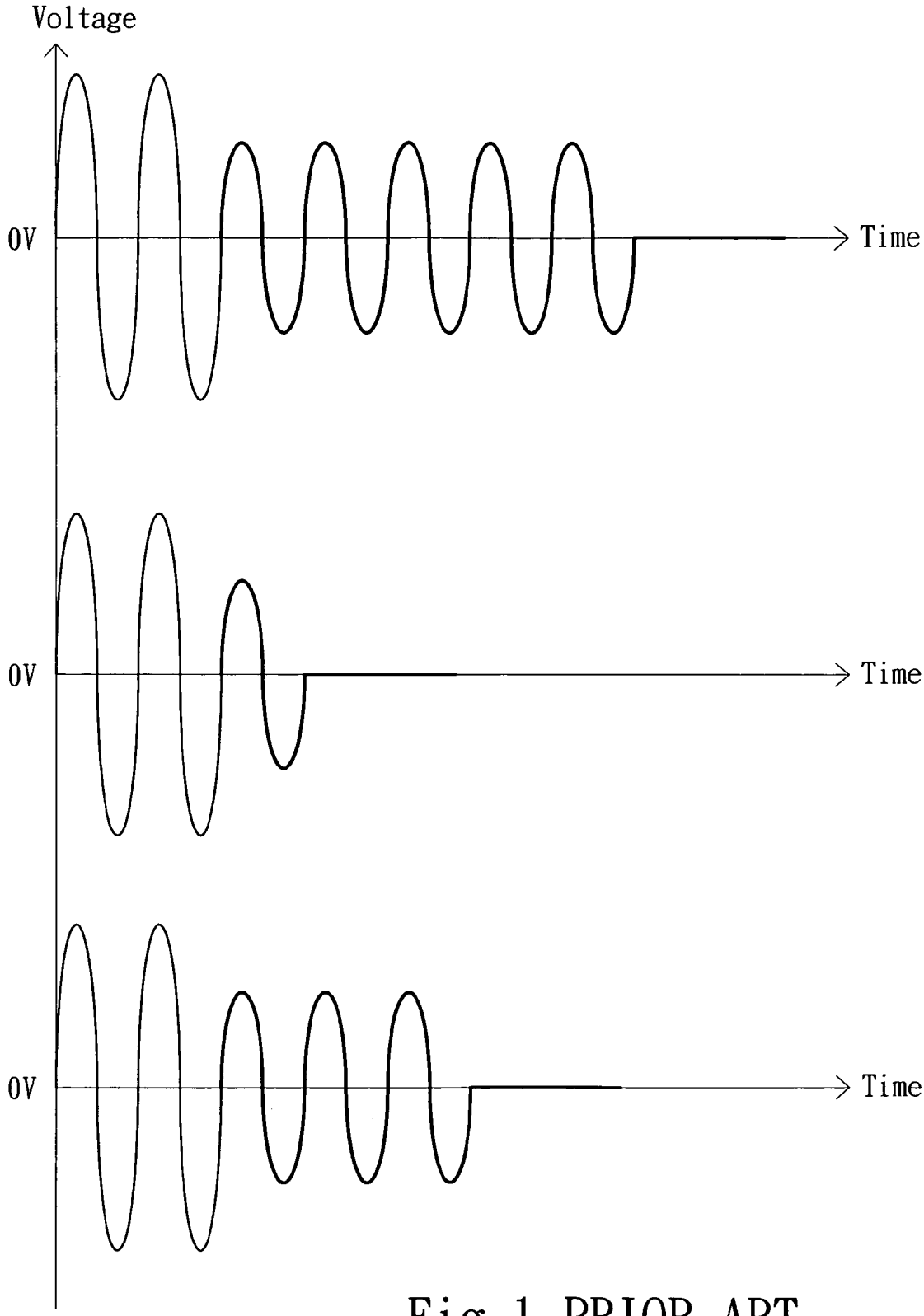
Fig. 1 PRIOR ART
FIG. 1 is a schematic view of a dimming cycle waveform of a conventional gas discharge lamp.
Figure 2:
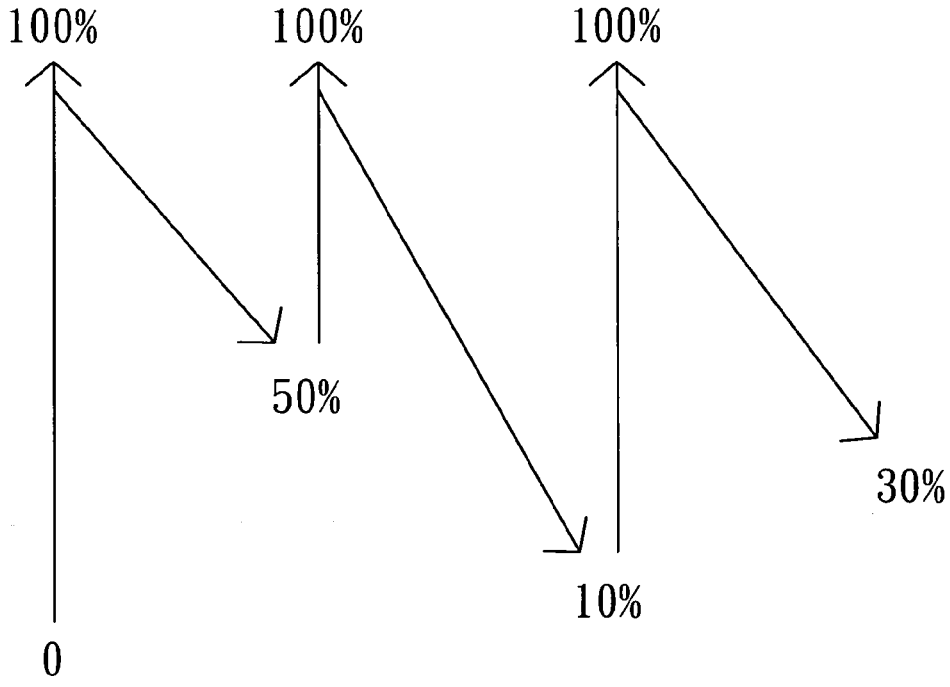
Fig. 2 PRIOR ART
FIG. 2 is a schematic view of a dimming value setting condition according to FIG. 1.
Figure 4:
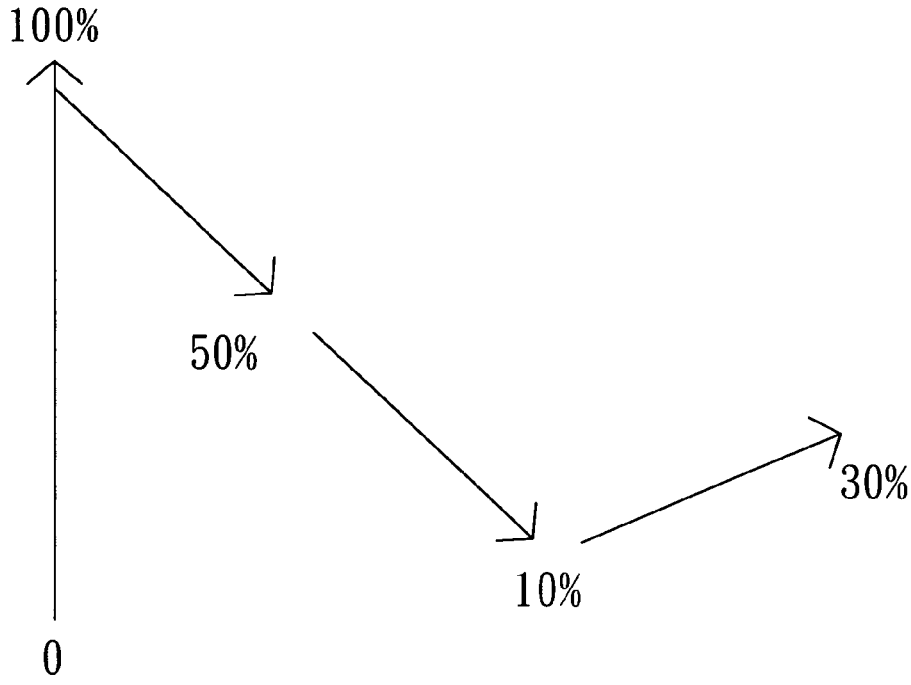
FIG. 4 is a schematic view of a dimming value setting condition according to FIG. 3.
Figure 3:
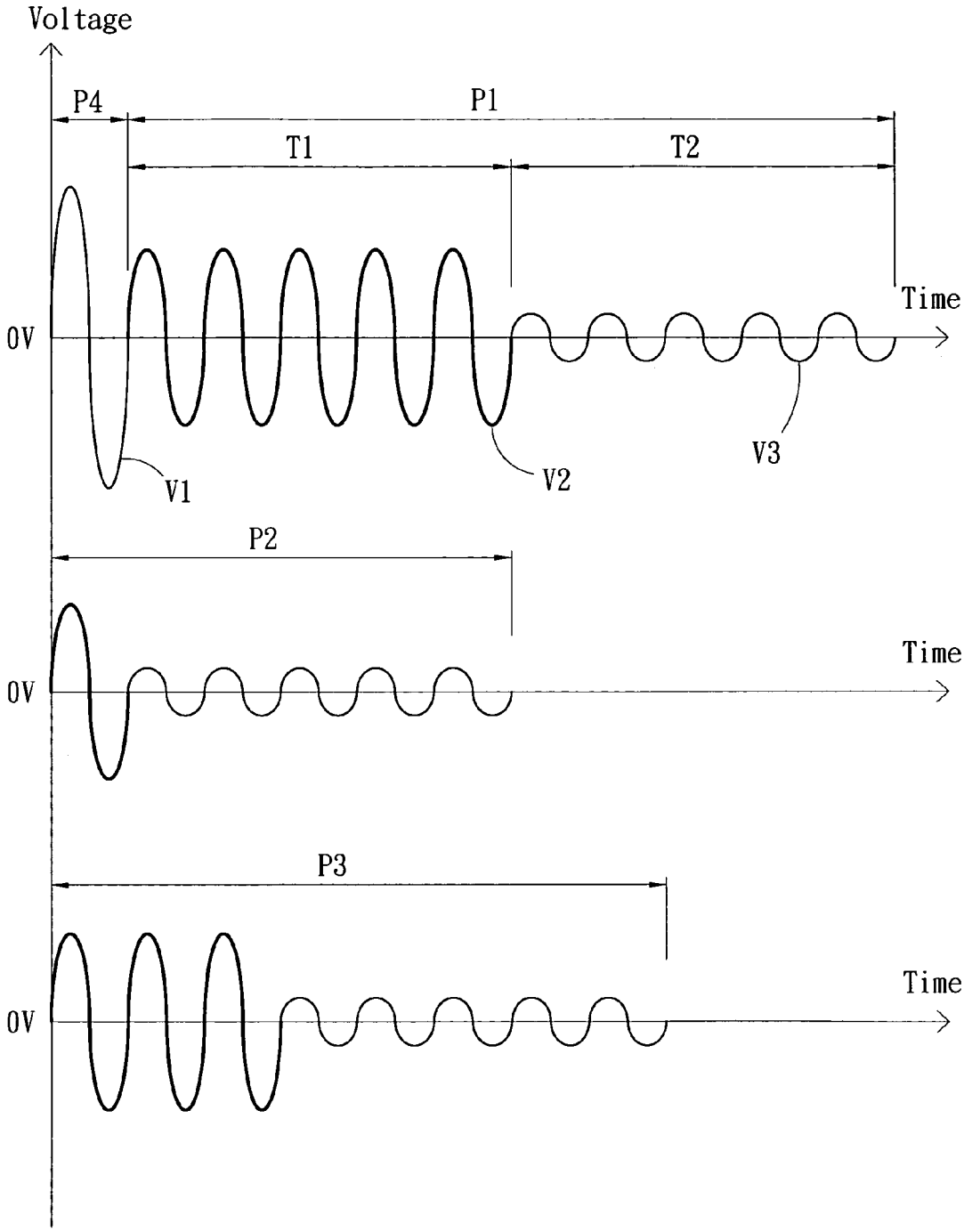
FIG. 3 is a schematic view of a dimming cycle waveform of a gas discharge lamp according to the invention.

Please refer to FIGS. 3 and 4 for the waveform of a dimming cycle P1 of a gas discharge lamp and a dimming value setting condition according to the invention. The invention provides a gas discharge lamp dimming cycle control method that consists of a start cycle P4 and a dimming cycle P1. The control method includes:

providing the start period P4 for igniting the gas discharge lamp. The start period P4 is generated at the initial start time before generation of the dimming period P1. The start voltage V1 in the start period P4 can provide required electric energy to ignite the gas discharge lamp at the initial period; and providing the dimming period P1 after the start period P4. The dimming period P1 has a duty voltage V2 set at the initial period or corresponding to a dimming value maintained during the previous OFF period of the gas discharge lamp. Hence the gas discharge lamp is provided with desired electric energy during the dimming period P1 in any dimming value setting and is maintained in a start condition. Moreover, the duty voltage V2 in the dimming period P1 lasts a length equal to the dimming period P1 corresponding to different dimming values. The dimming period P1 includes a duty time T1 and a standby time T2. The standby time T2 has a standby voltage V3 of a non-zero potential. The standby voltage V3 has an amplitude smaller or equal to the amplitude of the duty voltage V2. In addition, the duty frequency of the standby voltage V3 is different from that of the duty voltage V2. Therefore the gas discharge lamp can gradually restore the required dimming illumination in the start condition, and a maximum dimming range can be achieved.

Figure 5:
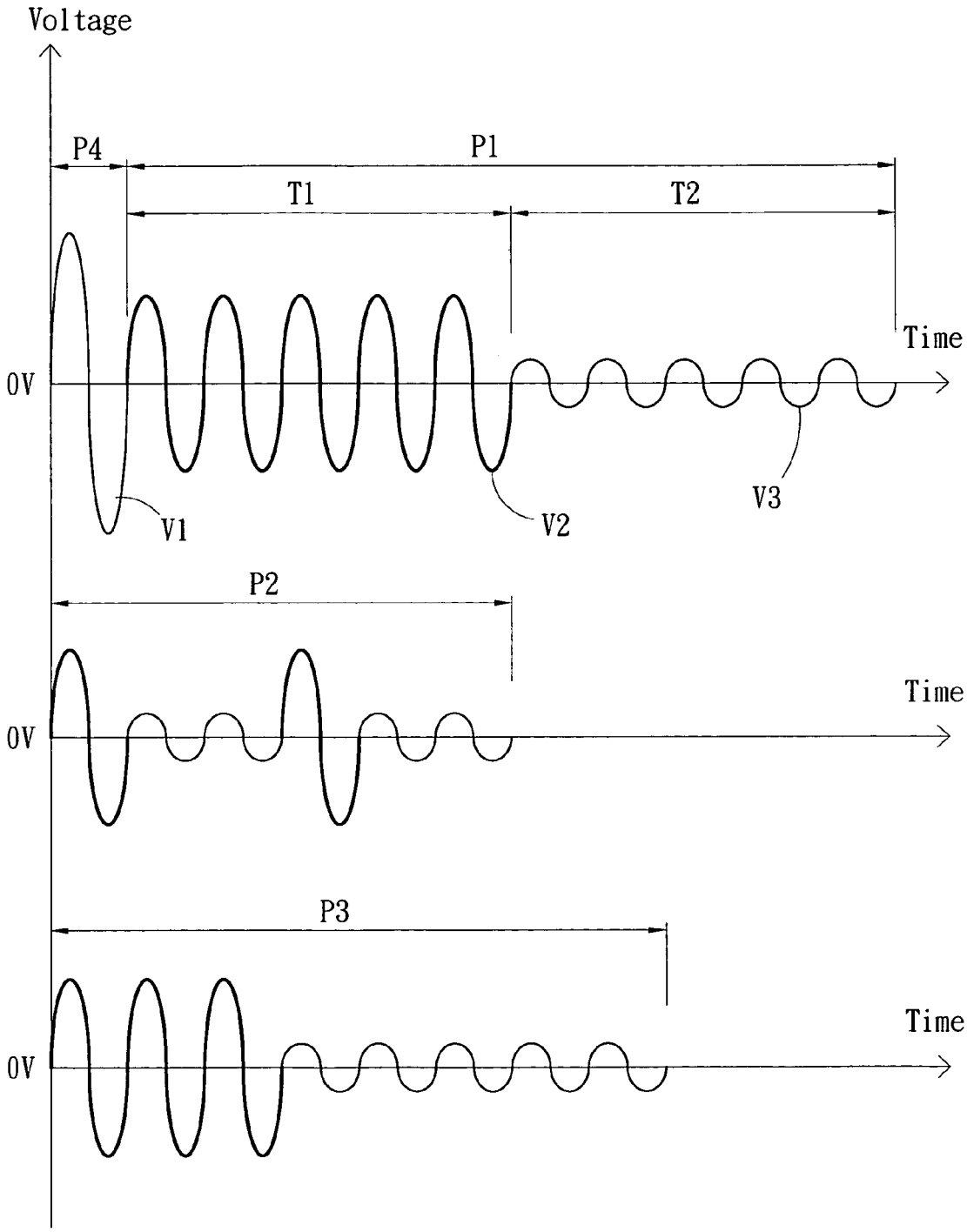
FIG. 5 is a schematic view of a dimming cycle waveform of a gas discharge lamp according another embodiment of the invention.

Referring to FIG. 3, a first dimming period P1 has a dimming value setting of 50% for dimming illumination. A second dimming period P2 has a dimming value setting of 10% for dimming illumination. A third dimming period P3 has a dimming value setting of 30% for dimming illumination. As shown in the drawing, when the dimming value setting of the gas discharge lamp is 10% for the dimming illumination, a different length of duty voltage V2 occurs to each of the dimming period P1, P2 and P3 corresponding to its dimming value setting. As the invention provides the duty voltage V2 and the non-zero potential standby voltage V3 during the second dimming period P2, electric energy is provided to maintain the gas discharge lamp in a dimmed condition rather than an OFF condition. Moreover, the duty voltage V2 is moved in a spaced manner (referring to FIG. 5, in the standby time T2 a duty voltage V2 may be included to mate a previous duty voltage V2 and distribute in a spaced manner. This alteration depends on the length of the gas discharge lamp or the required electric energy). Hence uneven illumination can be prevented. Referring to FIG. 4, even when the invention is in a lower dimming value setting condition, the electric energy of the gas discharge lamp is continuously maintained in an ON condition due to the duty voltage V2 and the standby voltage V3. Hence adjusting the dimming value setting to a higher condition can be accomplished by increasing the length of the duty voltage V2, and the gas discharge lamp can be gradually restored to the required dimming illumination. Thus the high start voltage and the impulse current resulting from repetitive start voltage V1 can be eliminated. And the service life of the gas discharge lamp and the front end inverter can be maintained without suffering.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A gas discharge lamp dimming control method, comprising the steps of:

providing a start period for igniting a gas discharge lamp; and providing a dimming period after the start period that has a duty voltage set initially or corresponding to a dimming value remained in a previous OFF period of the gas discharge lamp;

wherein the gas discharge lamp is provided with electric energy to maintain in a start condition during the dimming period in any dimming value setting condition, and the duty voltage in the dimming period lasting a length equal to the dimming period corresponding to different dimming values to allow the gas discharge lamp to gradually restore a desired dimming illumination and achieve a maximum dimming range.

2. The gas discharge lamp dimming control method of claim 1, wherein the start cycle is generated in an initial start condition of the gas discharge lamp and before the dimming period is generated.

3. The gas discharge lamp dimming control method of claim 1, wherein the dimming period includes a duty time and a standby time.

4. The gas discharge lamp dimming control method of claim 3, wherein the standby time has a standby voltage of a non-zero potential.

5. The gas discharge lamp dimming control method of claim 4, wherein the standby voltage has an amplitude smaller than that of the duty voltage.

6. The gas discharge lamp dimming control method of claim 4, wherein the standby voltage has an amplitude equal to that of the duty voltage.

7. The gas discharge lamp dimming control method of claim 4, wherein the standby voltage has a duty frequency different from that of the duty voltage.

* * * * *